US005166657A

United States Patent [19]

Buckshaw et al.

[11] Patent Number: 5,166,657

[45] Date of Patent: Nov. 24, 1992

[54] TEMPERATURE OPERATED SWITCH CONSTRUCTION AND METHOD OF MAKING THE SAME

[75] Inventors: Thomas M. Buckshaw, Indiana; David D. Martin, Dunbar, both of Pa.

[73] Assignee: Robertshaw Controls Company, Richmond, Va.

[21] Appl. No.: 861,476

[22] Filed: Apr. 1, 1992

[51] Int. Cl.[5] ..... H01H 37/36; H01H 87/00

[52] U.S. Cl. ..... 337/329; 337/122; 335/205

[58] Field of Search ..... 337/329, 330, 331, 332, 337/373, 414, 137, 122, 302, 303, 304; 335/205, 206, 207

[56] References Cited

U.S. PATENT DOCUMENTS 4,054,245 10/1977 Bennetsen et al. ..... 337/303

4,246,457 1/1981 Teichert et al. .

*Primary Examiner*—Harold Broome

*Attorney, Agent, or Firm*—Candor, Candor & Tassone

[57] ABSTRACT

A temperature operated switch construction, terminal block therefor and methods of making the same are provided, the switch construction comprising a housing, a movable switch arm carried in the housing, a temperature actuated unit disposed in the housing and being operatively interconnected to the switch arm to cause movement of the arm between operating positions thereof in relation to the temperature being sensed by the temperature actuated unit, the housing comprising a main part and a removable terminal block carried by the main part, the terminal block carrying a switch unit that is operatively associated with the switch arm so that the switch unit is in a first condition thereof when the switch arm is in a first operating position thereof and the switch unit is in a second condition thereof when the switch arm is in a second operating position thereof, the switch unit comprising a reed switch and the switch arm carrying a magnet for operating the reed switch to the conditions thereof as the switch arm is moved to the positions thereof, the switch arm carrying two springs for respectively engaging the housing when the switch arm is the different operating positions thereof.

20 Claims, 3 Drawing Sheets

TEMPERATURE OPERATED SWITCH CONSTRUCTION AND METHOD OF MAKING THE SAME

BACKGROUND OF THE INVENTION

1. Field of the Invention

This invention relates to a new temperature operated switch construction and to a new method of making such a temperature operated switch construction.

2. Prior Art Statement

It is known to provide a temperature operated switch construction comprising a housing means, a movable switch arm carried in the housing means, temperature actuated means disposed in the housing means and being operatively interconnected to the switch arm to cause movement of the switch arm between operating positions thereof in relation to the temperature being sensed by the temperature actuated means, the housing means comprising a main part and a removable terminal block carried by the main part, the terminal block carrying a switch means that is operatively associated with the switch arm so that the switch means is in a first condition thereof when the switch arm is in a first operating position thereof and the switch means is in a second condition thereof when the switch arm is in a second operating position thereof. For example, see FIGS. 1 and 2 of this application.

It is also known to form the switch means of said prior known switch construction as set forth above to comprise a reed switch means with the switch arm carrying a magnet for operating the reed switch means to the conditions thereof as the switch arm is moved to the positions thereof. For example see the allowed copending patent application to Thomas M. Buckshaw et al, Ser. No. 688,157, filed Apr. 19, 1991.

It is also known to operate a reed switch means through the movement of a switch arm that carries a magnet means. For example, see FIGS. 4 and 5 of this application.

It is also known to move such switch arm for influencing the operating condition of a reed switch means by temperature actuated means. For example, see the U.S. patent to Teichert et al, U.S. Pat. No. 4,246,457.

SUMMARY OF THE INVENTION

It is a feature of this invention to provide a new temperature operated switch construction wherein a reed switch means it utilized therein in a unique manner.

In particular, it has been found according to the teachings of this invention that a certain temperature operated switch construction or thermostat that normally has a switch arm moved by temperature actuated means so as to place contact means of that switch arm into electrical contact with or out of electrical contact from contact means carried by a terminal block of the switch construction is subject to the adverse effects of abnormal environments, such as elevated temperatures, light electrical loads and the presence of cooking oil vapors and greases.

Therefore, it was found according to the teachings of the invention set forth in the aforementioned copending patent application, Ser. No. 688,157 filed Apr. 19, 1991 that the basic structure of such a temperature operated switch construction can be utilized with a hermetically sealed reed switch by replacing the contact means on the switch arm with a permanent magnet means and providing a special terminal block to replace the terminal block of the temperature operated switch construction, such new terminal block having the reed switch mounted therein so that the reed switch contacts make and break as the magnet means changes position relative to the location of the reed switch.

However, it was found according to the teachings of this invention that such a temperature operated switch construction has a movable switch arm that travels less than 1/16 of an inch whereas magnetically operated reed switches each normally require the movement of the magnet thereof to be in excess of the 1/16 of an inch, such as a movement of ⅛ of an inch.

In order to provide for ⅛ of an inch movement of the switch arm of the prior known switch construction this would increase the differential of the switch construction (the difference between off and on snaps in degrees Fahrenheight) to a level that is unacceptable for many applications.

Thus, it was found according to the teachings of this invention that the magnet movement can be made to be approximately ⅛ of an inch for proper reed switch control without effectively increasing the switch differential by increasing the travel of the switch arm and by adding to the switch arm differential compensating spring means.

For example, one embodiment of this invention comprises a temperature operated switch construction comprising a housing means, a movable switch arm carried in the housing means, temperature actuated means disposed in the housing means and being operatively interconnected to the switch arm to cause movement of the arm between operating positions thereof in relation to the temperature being sensed by the temperature actuated means, the housing means comprising a main part and a removable terminal block carried by the main part, the terminal block carrying a switch means that is operatively associated with the switch arm so that the switch means is in a first condition thereof when the switch arm is in a first operating position thereof and the switch means is in a second condition thereof when the switch arm is in a second operating position thereof, the switch means comprising a reed switch means and the switch arm carrying a magnet means for operating the reed switch means to the conditions thereof as the switch arm is moved to the positions thereof, the switch arm carrying spring means having opposed end means one of which is adapted to engage the housing means while the other of which is out of engagement with the housing means when the switch arm is in the first operating position thereof and the other opposed end means being adapted to engage the housing means while the one opposed end means is out of engagement with the housing means when the switch arm is in the second operating position thereof.

It is another feature of this invention to provide a unique terminal block for such a temperature operated switch construction.

Accordingly, it is an object of this invention to provide a new temperature operated switch construction having one or more of the novel features of this invention as set forth above or hereinafter shown or described.

Another object of this invention is to provide a new method of making such a temperature operated switch construction, the method of this invention having one or more of the novel features of this invention as set forth above or hereinafter shown or described.

Another object of this invention is to provide a new terminal block for a temperature operated switch construction, the terminal block of this invention having one or more of the novel features of this invention as set forth above or hereinafter shown or described.

Another object of this invention is to provide a new method of making such a terminal block, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
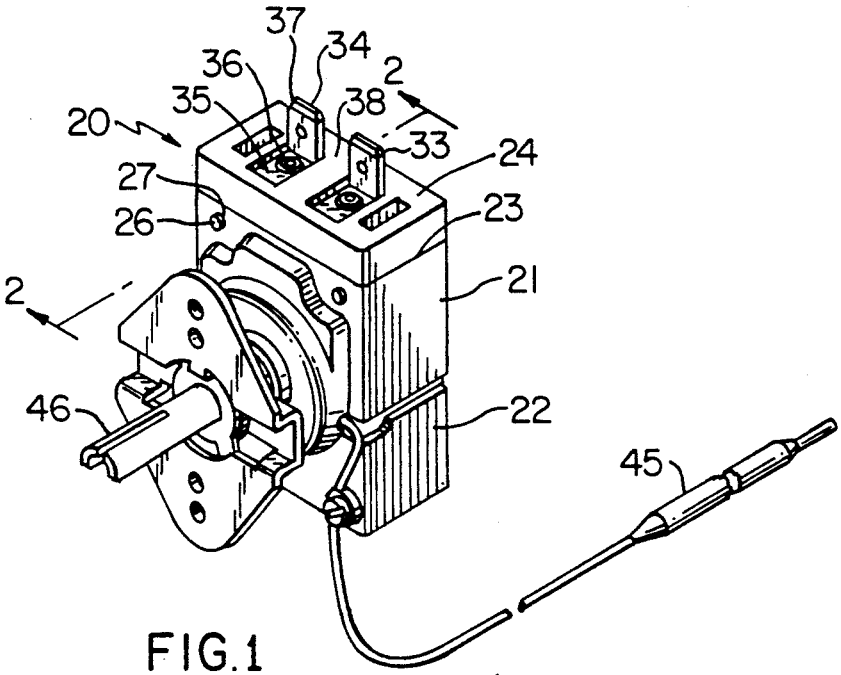
FIG.1 PRIOR ART
FIG. 1 is a front perspective view of a prior known temperature operated switch construction.

While the various features of this invention are hereinafter illustrated and described as being particularly adapted to provide a temperature operated switch construction of a certain configuration, it is to be understood that the various features of this invention can be utilized singly or in various combinations thereof to provide structure for other types of temperature operated switch constructions, as desired.

Therefore, this invention is not to be limited to only the embodiment thereof that is illustrated in the drawings, because the drawings are merely utilized to illustrate one of the wide variety of uses of this invention.

Figure 2:
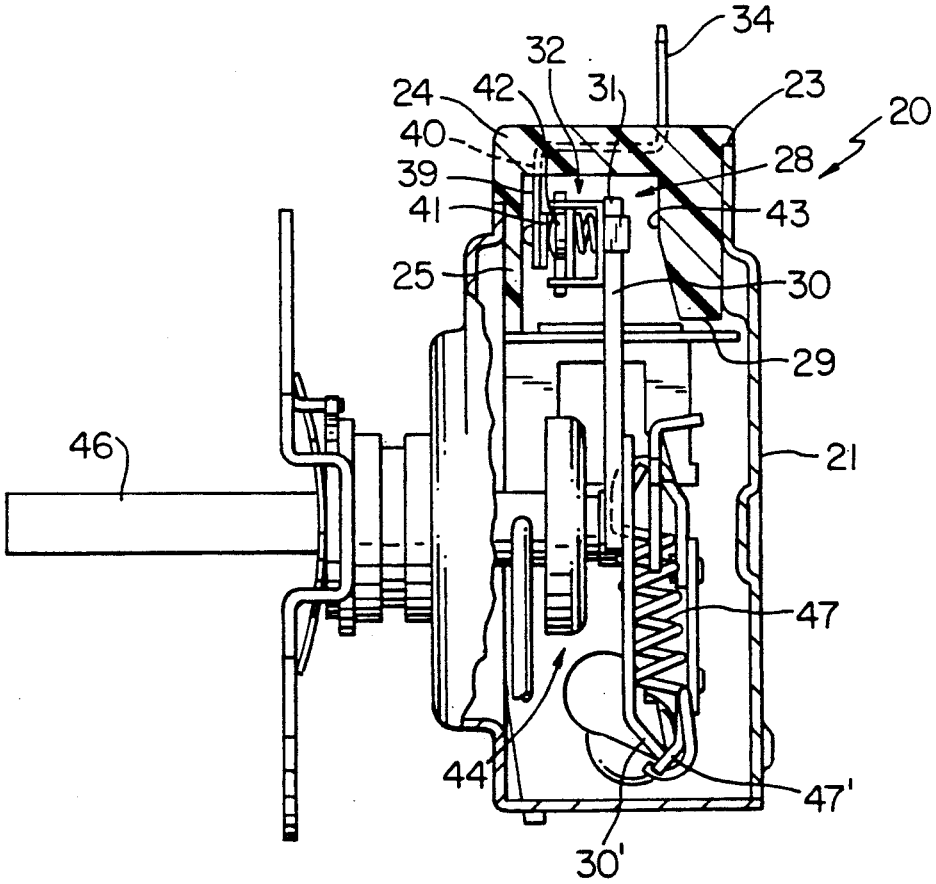
FIG.2 PRIOR ART
FIG. 2 is an enlarged fragmentary cross-sectional view taken on line 2—2 of FIG. 1.

Referring now to FIGS. 1 and 2, a prior known temperature operated switch construction is generally indicated by the reference numeral 20 and comprises a housing means 21 formed of a metallic casing or part 22 having an open end 23 in which a terminal block 24 has a portion 25 thereof disposed therein and being secured thereto by threaded fastening members 26 passing through suitable openings 27 in the casing 22 and aligned openings (not shown) in the terminal block 24 to hold the terminal block 24 in its assembled relation as illustrated in FIGS. 1 and 2 in a manner well known in the art.

The terminal block 24 is formed of electrically insulating material, such as polymeric material, and has a cavity 28 therein that interrupts a lower surface means 29 thereof so that a movable arm 30 can have an upper end or part 31 thereof project into the cavity 28 and be movable therein as will be apparent hereinafter, the movable arm 30 operating an electrical switch means that is generally indicated by the reference numeral 32 in FIG. 2 and is carried by the terminal block 24.

In particular, the switch means 32 comprises two like conductive terminals 33 and 34 each having an intermediate portion 35 secured to the terminal block 24 by a fastening means 36 so that an upstanding portion 37 thereof projects upwardly from a top surface 38 of the terminal block 24 and another portion 39 thereof extends through an opening 40 in the terminal block 24 to project into the cavity 28 and carry a contact 41 thereon.

The end or part 31 of the switch arm 30 carries a contact bar means 42 that is adapted to engage against the contacts 41 of the terminals 33 and 34 so as to conductively bridge or electrically interconnect the same together when the arm 30 is in its left-hand position as illustrated in FIG. 2. However, when the arm 30 is moved to the right so as to engage against a stop surface 43 of the terminal block 24, the bridging contact member 42 is held out of contact with the contacts 41 of the terminals 33 and 34 so as to prevent electrical connection therebetween.

In this manner, the terminals 33 and 34 can be interconnected by suitable external leads (not shown) to any desired means, such as a load means, to be operated only when the switch arm 30 is holding the contact bar means 42 in electrical contact with the contacts 41.

The switch blade 30 is moved between its operating positions by a temperature actuated means that is generally indicated by the reference numeral 44 in FIG. 2 and has a temperature sensing bulb 45 and a selector shaft 46, all parts that are well known in the art whereby the setting of the selector shaft 46 determines the temperature that the temperature sensing bulb 45 senses to cause the switch blade 30 to be disposed in the contact closing condition of FIG. 2 and what temperature the temperature sensing bulb 45 senses to move the switch arm 30 out of the contact closing position thereof all in a manner well known in the art.

For example, while the switch blade 30 of the temperature operated switch construction 20 is adapted to be snapped between its operating positions by spring means 47 and having its lower end or part 30' pivotally mounted to lever structure 47', it is to be understood that any suitable temperature actuated means can be utilized to move the switch blade 30 to its pivoted left-hand position as illustrated in FIG. 2 and to its right-hand pivoted position wherein the same is engaging against the stop means 43 as desired.

Such a temperature operated switch construction or thermostat 20 is a part well known in the art and can be purchased as a K thermostat from the Robertshaw Controls Company of Richmond, Va.

However, as previously stated, it is a feature of this invention to replace the switch means 32 of the temperature operated switch construction 20 with a reed switch means that is uniquely carried by a terminal block assembly that is adapted to replace the terminal block 24 of the switch construction 20 so as to form a new temperature operated switch construction that still utilizes a major portion of the previously designed parts in a manner similar to the temperature operated switch construction of the invention set forth in the aforementioned copending patent application, Ser. No. 688,157, filed Apr. 19, 1991, and since this application is now allowed by the United States Patent and Trademark Office, this application is being incorporated into this disclosure by this reference thereto.

The new temperature operated switch construction of this invention is generally indicated by the reference numeral 20A in FIGS. 3 and 6–9 and parts thereof similar to the switch construction 20 previously described are indicated by like reference numerals followed by the reference letter "A".

Figure 3:
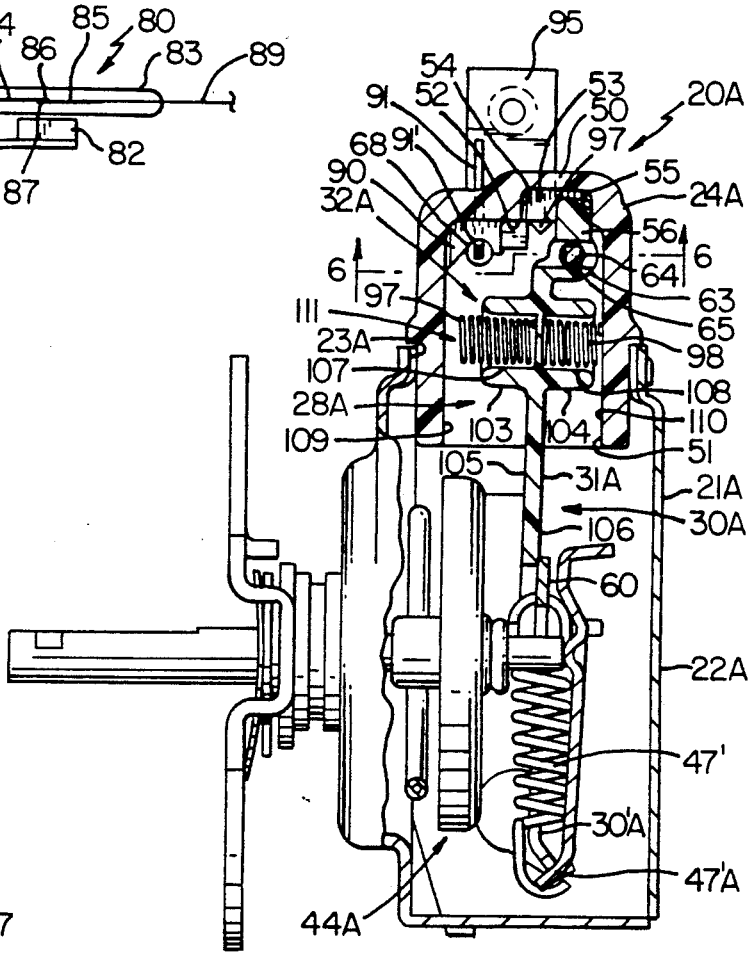
FIG. 3 is a fragmentary view similar to FIG. 2 and illustrates the new temperature operated switch construction of this invention.

As illustrated in FIG. 3, the temperature operated switch construction 20A of this invention includes the housing means 21A, the temperature actuated means 44A and the switch arm 30A, the housing means 21A comprising the casing 22A previously described having the open end 23A thereof closed by a new terminal block means 24A of this invention that carries a switch means 32A in a manner hereinafter set forth while the switch blade 30A of this invention comprises a new upper part 31A thereof as will be apparent hereinafter.

The terminal block 24A of this invention is formed of electrically insulating material, such as polymeric material, and is relatively long in the cup-shape thereof so as to define a closed end 50 and an open end 51 thereof while the cavity 28A thereof faces into the casing 22A and is secured thereto by the fastening means 26A previously described.

Figure 9:
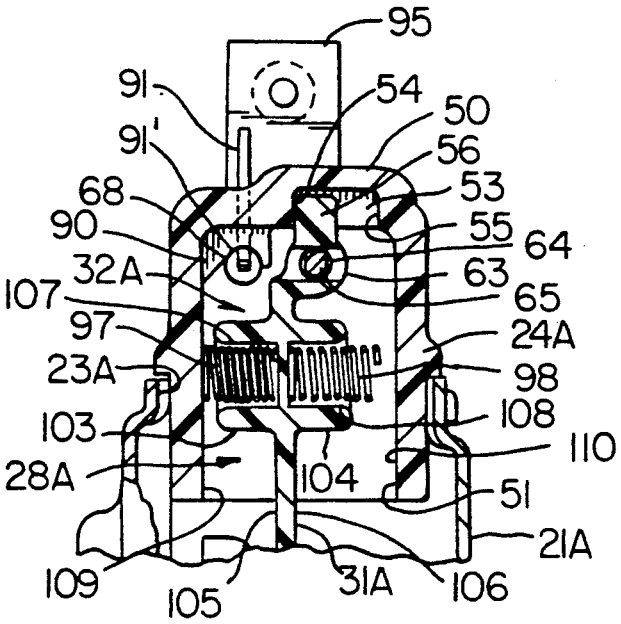
FIG. 9 is a fragmentary view similar to FIG. 3 and illustrates the switch construction in another operating condition thereof.

The closed end 50 of the terminal block 24A has a substantially flat rectangular inside surface means 52 that is interrupted by a cavity or recess 53 that is also substantially rectangular in shape and defines a pair of opposed stop means or walls 54 and 55 against which a substantially cylindrical end projection 56 of the part 31A of the arm 30A is adapted to be engaged to limit the snap movement of the arm 30A from the switch open position of the arm 30A in FIG. 3 to the switch closed position of the arm 30A as illustrated in FIG. 9.

The part 31A of the arm 30A has openings 57 formed through legs 58 thereof which are adapted to align with openings 59 formed through a cross member 60 of the lower part 30'A of the arm 30A so as to be fastened thereto by suitable fastening means, such as rivets (not shown), disposed in the aligned openings 57 and 59 in a manner well known in the art whereby the parts 31A and 30'A of the switch arm 30A will move in unison as the switch arm 30A pivots on the lower end of the legs 61 of the part 30'A that cooperate with the part 47'A and the spring means 47A all in a manner well known in the art.

Figure 10:
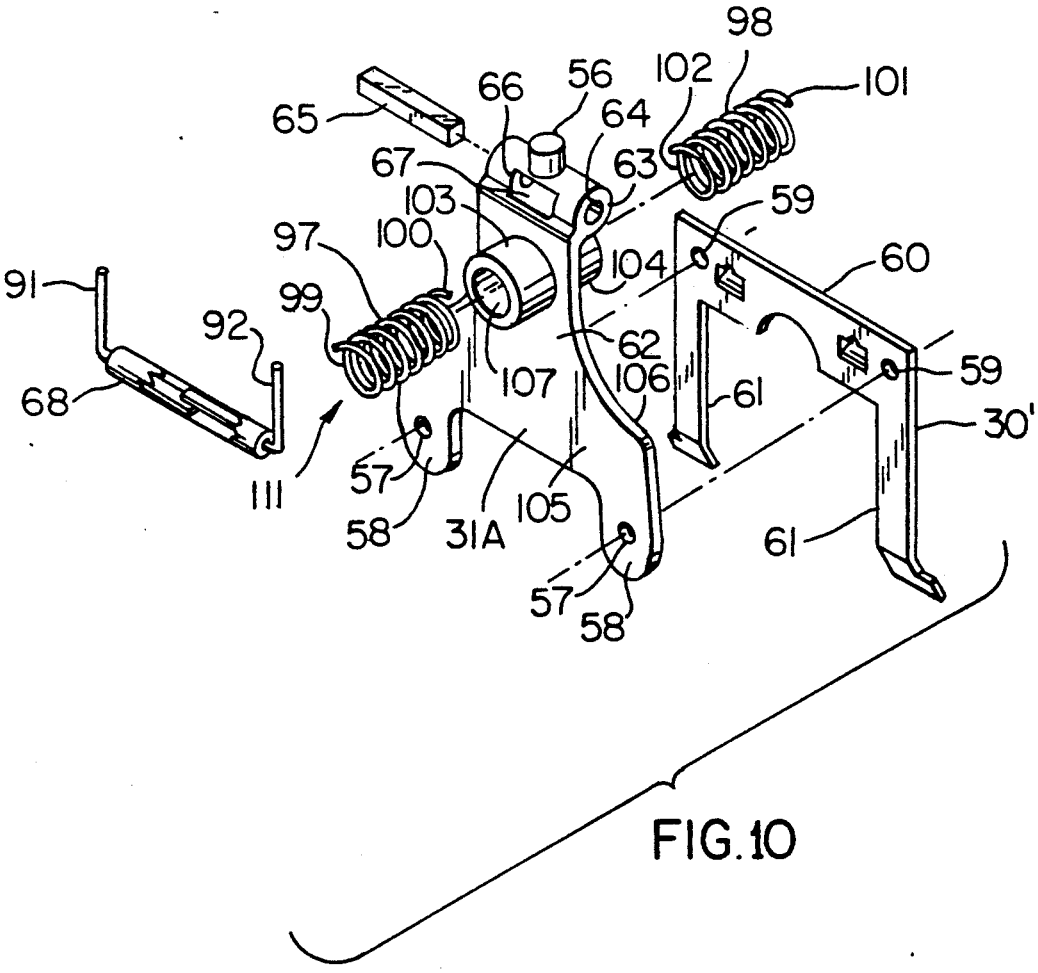
FIG. 10 is an exploded perspective view of the various parts of the switch arm of this invention as well as of the reed switch utilized therewith.

The part 31A of the switch arm 30A is formed of any suitable insulating material, such as polymeric material and has a substantially flat body portion 62 with a tubular end portion 63 disposed offset relative to and transverse to a longitudinal axis (not shown) of the body portion 62, the tubular portion 63 having a cylindrical opening 64 passing therethrough and in which a permanent magnet 65 is adapted to be press-fit so as to be carried thereby. For example, the permanent magnet 65 can have a substantially rectangular cross-sectional configuration so as to cause the same to be readily press-fit into the cylindrical opening 64 in the manner illustrated in FIGS. 3 and 10. However, it is to be understood that the magnet 65 could be secured in the opening 64 of the arm part 31A in any other suitable manner, if desired.

In addition, a section 66 of the tubular part 63 of the arm part 31A can be cut away to provide a window 67 which fully exposes the magnet 65 to the exterior of the arm part 31A without any shielding effect being provided by the material of the arm part 31 so as to affect the magnet field of the magnet 65 in regard to its influence on a reed switch 68 carried by the terminal block 24A in a manner hereinafter set forth and comprising the switch means 32A of the temperature operated switch construction 20A.

The reed switch 68 comprises a hermetically sealed device that can be of the normally open or the normally closed type and is adapted to be influenced by the magnetic field of the permanent magnet 65 that is carried by the part 31A of the switch arm 30A so that when the end projection 56 of the switch arm 30A is snapped by the temperature actuated means 44A against the stop surface 55 of the terminal block 24A as illustrated in FIG. 3, the reed switch means 68 is in one operating condition thereof and when the arm 30A is snapped by the temperature actuated means 44A so as to have the end part 56 thereof disposed against the other stop means 54 in the manner illustrated in FIG. 9, the reed switch means 68 is in another operating condition thereof, such operation of a reed switch means being well known in the art.

Figure 4:
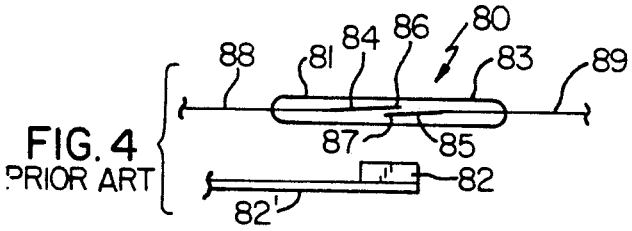
FIG. 4 PRIOR ART
FIG. 4 is a schematic view illustrating a prior known reed switch means, FIG. 4 illustrating the reed switch in an open condition thereof.
Figure 5:
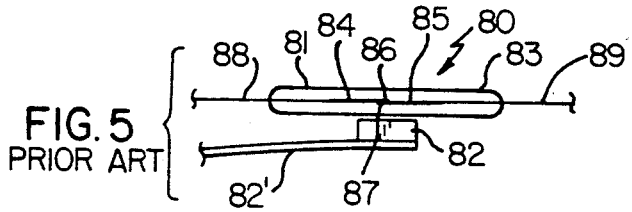
FIG. 5 PRIOR ART
FIG. 5 is a view similar to FIG. 4 and illustrates the reed switch means in a closed condition thereof.

For example, reference is now made to FIGS. 4 and 5 wherein a prior known reed switch means is generally indicated by the reference numeral 80 and comprises a reed switch 81 and a movable magnet means 82, the reed switch 81 having a hermetically sealed glass envelope 83 containing two switch blades 84 and 85 therein that normally have the respective ends 86 and 87 thereof disposed spaced apart from each other through the natural resiliency of the blades 84 and 85 whereby electrical current cannot flow through the reed switch 81 from an external lead 88 of the switch blade 84 to an external lead 89 of the switch blade 85. However, when the permanent magnet 82 is moved toward the reed switch 81 in the manner illustrated in FIG. 5, such as by movement of a switch blade 82' carrying the permanent magnet 82, the magnetic field of the magnet 82 causes the ends 86 and 87 of the switch blades 84 and 85 to move together in the manner illustrated in FIG. 5 and thereby close the switch 81 so that electrical current can flow between the external leads 88 and 89 through the switch means 81 all in a manner well known in the art.

Thus, when the switch blade 82' moves the permanent magnet 82 away from the switch 81 a certain distance, the reduced magnetic field being imposed on the ends 86 and 87 of the switch blades 84 and 85 is insufficient to overcome the natural resiliency of the blades 84 and 85 so that the ends 86 and 87 can again move apart in the manner illustrated in FIG. 4 and thereby prevent electrical connection between the leads 88 and 89.

Of course, as previously stated the reed switch 81 can be of the type that is normally closed so that the movement of the magnet 82 toward the reed switch 81 opens the contacts rather than close the same as is well known in the art.

In any event, it can be seen that the reed switch 68 of the terminal block 24A of this invention will be in one condition thereof when the switch arm 30A is disposed against the stop wall 55 of the terminal block 24A in the manner illustrated in FIG. 3 and the reed switch 68 will be in the other operating condition thereof when the switch arm 30A is against the stop wall 54 in the manner illustrated in FIG. 9, such movement of the switch arm 30A being under the control of the temperature actuated means 44A sensing certain temperature conditions as previously set forth.

Figure 6:
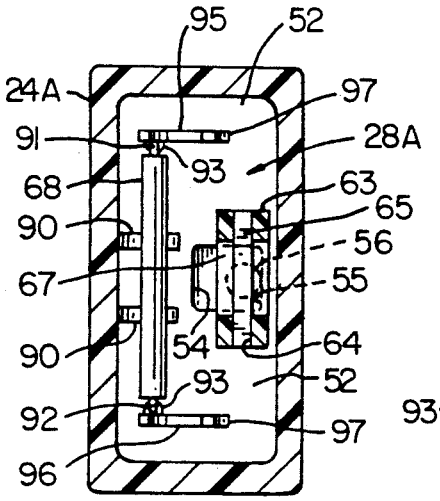
FIG. 6 is a cross-sectional view taken on lines 6—6 of FIG. 3.
Figure 7:
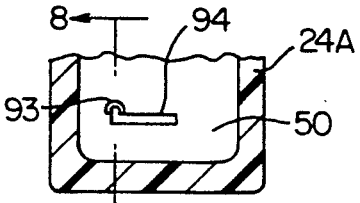
FIG. 7 is a fragmentary view similar to FIG. 6 with the reed switch and terminal removed.

The terminal block 24A has a pair of projections 90 extending outwardly from the surface 52 thereof in spaced apart parallel relation with each projection 90 having an arcuate external surface 91' against which the reed switch 68 is positioned and held as opposed leads 91 and 92 thereof are respectively pushed through opening portions 93 of terminal openings 94 formed through the closed end 50 of the terminal block 24A, the terminal openings 94 respectively having conductive terminals 95 and 96 disposed therein and each having one or more parts 97, FIG. 3, staked against the inside surface 52 of the closed end 50 of the terminal block 24A while a shoulder portion (not shown) of each terminal 95 and 96 engages against the outside surface of the terminal block 24A whereby the terminals 95 and 96 are fastened in their inserted condition as illustrated in FIGS. 3 and 6 for electrical leads to be interconnected thereto in a manner well known in the art.

In this manner, the leads 91 and 92 of the reed switch 68 will respectively engage against the terminals 95 and 96 and can be sequentially spot welded thereto externally of the terminal block 24A so as to assure electrical connection therebetween. However, it is to be understood that a press-fit arrangement between the leads 91 and 92 and the terminals 95 and 96 can be provided at the slot means 93, 94 so that the reed switch 68 will be held in position and good electrical contact will be provided between the leads 91, 92 and terminals 95, 96 without any spot welding, if desired.

Figure 8:
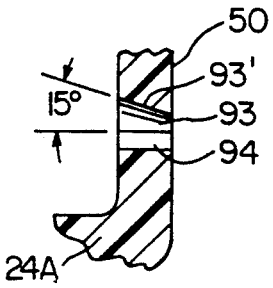
FIG. 8 is an enlarged fragmentary cross-sectional view taken on lines 8—8 of FIG. 7.

It can be seen in FIG. 8 that the opening portion 93 of the respective slot 94 has one wall 93' thereof angled relative to the respective slot 94 with such angle being approximately 15 degrees as illustrated in FIG. 8 in order to facilitate the insertion of the respective lead 91 and 92 through the opening portion 93 from inside the terminal block 24A to the outside thereof.

As previously stated, the temperature actuated mechanism 44A of the switch construction 20A of this invention was designed to operate the electrical switch means 32 of FIG. 2 and to operate the same with a movement of the switch blade 30 of FIG. 2 at the contact 41 of less than approximately 1/16 of an inch when the control mechanism 44A snaps the switch arm 30 back and forth. If the travel of the movable switch arm 30 exceeds approximately 1/6 of an inch, the differential of the switch construction (the difference between on and off snaps in degrees Fahrenheit) increases to a level that is unacceptable for many applications.

However, typically magnetically operated reed switches each often require movements of their respective magnet in excess of 1/16 of an inch to make and break the reed switch contacts.

Therefore, the length of the switch arm 30A of this invention is made longer than the switch arm 30 of the prior art switch construction 20 of FIG. 2 and this is accomplished by putting the rectangular recess 53 in the closed end 50 of the terminal block 24A together with having the cylindrical projection 56 on the end of the part 31A of the arm 30A of this invention. The cylindrical projection 56 controls the back and forth movement of the switch arm 30A as the same will engage respectively against the stop walls 54 and 55 as previously described. Such arrangement permits the switch arm 30A to move approximately ⅛ of an inch at the location of the permanent magnet 65 whereby adequate movement is provided to permit the reed switch 68 to be activated and deactivated. However, this also would increase the differential provided by the operating mechanism 44A.

Thus, it was found according to the teachings of this invention that in order to utilize the increased movement of the switch arm 30A without increasing the thermostat differential, a pair of differential compensating springs 97 and 98 could be utilized, the springs 97 and 98 each comprising a coiled compression spring having opposed ends 99 and 100 and 101 and 102 respectively.

The arm part 31A of the switch arm of this invention has a pair of tubular sections 103 and 104 respectively extending outwardly from opposed sides 105 and 106 of the body section 62 of the part 31A in aligned relation and respectively having openings 107 and 108 therein which respectively receive the ends 100 and 102 of the springs 97 and 98 therein in the manner illustrated in FIGS. 3 and 9 in a loose manner. However, the springs 97 and 98 cannot fall out of the tubular sections 103 and 104 because of the opposed flat interior side walls 109 and 110 of the terminal block 24A once the switch arm 30A and springs 97 and 98 have been assembled in the housing means 21A.

Thus, in effect, the two springs 97 and 98 define a spring means that is generally indicated by the reference numeral 111 in the drawings that has opposed ends 99 and 101 and a longitudinal axis that is substantially transverse to the body section 62 of the arm part 31A to respectively engage against the walls 109 and 110 in a unique manner to compensate for the increased movement of the switch arm 30A at the magnet carrying part 63 thereof.

In particular, the length of the springs 97 and 98 has been selected in relation to the distance between the interior side walls 109 and 110 of the terminal block 24A so that over the first approximate 1/16 of an inch movement of the switch arm 30A in either direction thereof, the springs 97 and 98 are moved without being compressed.

For example, when the switch arm 30A is snapped by the mechanism 44A from the position illustrated in FIG. 3 to the position illustrated in FIG. 9, the end 99 of the spring 97 only initially makes contact with the wall 109 of the terminal block 24A after the switch arm 30A has moved approximately 1/16 of an inch so that the remaining 1/16 of an inch of travel of the arm 30A at the portion 63 thereof causes the spring 97 to be slightly compressed, the spring 98 being uncompressed during the first 1/16 of an inch travel of the switch arm 30A. When the switch arm 30A is snapped from the position of FIG. 3 back to the position illustrated in FIG. 9 by the mechanism 44A, the first approximately 1/16 of an inch movement of the switch arm 30A does not cause the end 101 of the spring 98 to engage the wall 110 so that the spring 97 is moving to its uncompressed condition. The remaining 1/16 of an inch travel of the switch arm 30A toward the wall 110 causes the end 101 of the spring 98 to engage the wall 110 and the spring 98 to slightly compress.

Thus, at any one time, one of the springs 97 and 98 is decompressing during the first 1/16 of an inch movement of the switch arm 30A and then during the last 1/16 of an inch movement of the switch arm 30A, the other of the springs 97 and 98 is being compressed.

It has been found that the slight extra force gained from these differential compensating springs 97 and 98 substantially cancels out the tendency of increased differential from the extra switch arm movement that is controlled by the cylindrical projection 56 of the arm 30A engaging the stop walls 54 and 55.

It has also been found that by forming the projection 56 with a cylindrical configuration, the molded arm part 31A can be slightly canted in its assembly in the switch construction 20A without reducing the movement of the projection 56 within the recess 53 of the terminal block 24A.

Therefore, it can be seen that it is a relatively simple method of this invention to form the temperature operated switch construction 20A so as to operate in the manner previously described whereby the permanent magnet 65 is adapted to be moved back and forth relative to the reed switch 68 to cause the reed switch 68 to close when the magnet 65 is in one position relative to the reed switch 68 and then to cause the reed switch 68 to open when the magnet 65 is in the other operating position relative to the reed switch 68 all in the manner previously described with the springs 97 and 98 allowing for a relatively large movement of the magnet 65 relative to the reed switch without causing a change in the thermostat differential that determines the temperatures that causes the temperature actuated means 44A to snap the switch arm 30A back and forth for the reasons previously set forth.

While the terminal block 24A and the part 31A of the switch arm 30A can be formed by molding polymeric material in a manner well known in the art, it is to be understood that such parts can be formed in any other suitable manner and of any other suitable material.

Therefore, not only does this invention provide a new temperature operated switch construction, but also this invention provides a new method of making a temperature operated switch construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a temperature operated switch construction comprising a housing means, a movable switch arm carried in said housing means, temperature actuated means disposed in said housing means and being operatively interconnected to said switch arm to cause movement of said arm between operating positions thereof in relation to the temperature being sensed by said temperature actuated means, said housing means comprising a main part and a removable terminal block carried by said main part, said terminal block carrying a switch means that is operatively associated with said switch arm so that said switch means is in a first condition thereof when said switch arm is in a first operating position thereof and said switch means is in a second condition thereof when said switch arm is in a second operating position thereof, said switch means comprising a reed switch means, said switch arm carrying a magnet means for operating said reed switch means to said conditions thereof as said switch arm is moved to said positions thereof, the improvement wherein said switch arm carries spring means having opposed end means one of which engages said housing means while the other of which is out of engagement with said housing means when said switch arm is in said first operating position thereof and said other opposed end means engages said housing means while said one opposed end means is out of engagement with said housing means when said switch arm is in said second operating position thereof.

2. A switch construction as set forth in claim 1 wherein said spring means has a longitudinal axis that is disposed substantially transverse to said switch arm.

3. A switch construction as set forth in claim 1 wherein said spring means comprises two separate springs respectively defining said opposed end means.

4. A switch construction as set forth in claim 3 wherein each of said two springs comprises a coiled compression spring.

5. A switch construction as set forth in claim 4 wherein said switch arm has a pair of opposed tubular sections extending from opposed sides thereof and respectively receiving first parts of said springs therein so that second parts of said springs respectively extend beyond said tubular sections.

6. A switch construction as set forth in claim 1 wherein said terminal block has spaced apart stop means that are respectively engaged by said switch arm and thereby determines said positions thereof.

7. A switch construction as set forth in claim 6 wherein said terminal block is cup-shaped so as to have a closed end means and an open end means, said closed end means having a cavity therein that defines said spaced apart stop means.

8. A switch construction as set forth in claim 7 wherein said switch arm has an outer end provided with a projection thereon that extends into said cavity for respectively engaging against said spaced apart stop means.

9. A switch construction as set forth in claim 8 wherein said switch arm has a longitudinal axis and wherein said switch arm carries said magnet in an offset relation to said longitudinal axis thereof.

10. A switch construction as set forth in claim 9 wherein said switch arm has a tubular section disposed substantially transverse to said longitudinal axis thereof, said magnet being press fit into said tubular section.

11. In a method of making a temperature operated switch construction comprising a housing means, a movable switch arm carried in said housing means, temperature actuated means disposed in said housing means and being operatively interconnected to said switch arm to cause movement of said arm between operating positions thereof in relation to the temperature being sensed by said temperature actuated means, said housing means comprising a main part and a removable terminal block carried by said main part, said terminal block carrying a switch means that is operatively associated with said switch arm so that said switch means is in a first condition thereof when said switch arm is in a first operating position thereof and said switch means is in a second condition thereof when said switch arm is in a second operating position thereof, said switch means comprising a reed switch means, said switch arm carrying a magnet means for operating said reed switch means to said conditions thereof as said switch arm is moved to said positions thereof, the improvement comprising the step of forming said switch arm to carry spring means having opposed end means one of which engages said housing means while the other of which is out of engagement with said housing means when said switch arm is in said first operating position thereof and said other opposed end means engages said housing means while said one opposed end means is out of engagement with said housing means when said switch arm is in said second operating position thereof.

12. A method of making a switch construction as set forth in claim 11 and including the step of forming said spring means to have a longitudinal axis that is disposed substantially transverse to said switch arm.

13. A method of making a switch construction as set forth in claim 11 and including the step of forming said spring means to comprise two separate springs respectively defining said opposed end means.

14. A method of making a switch construction as set forth in claim 13 and including the step of forming each of said two springs to comprise a coiled compression spring.

15. A method of making a switch construction as set forth in claim 14 and including the step of forming said switch arm to have a pair of opposed tubular sections extending from opposed sides thereof and respectively receiving first parts of said springs therein so that second parts of said springs respectively extend beyond said tubular sections.

16. A method of making a switch construction as set forth in claim 11 and including the step of forming said terminal block to have spaced apart stop means that are respectively engaged by said switch arm and thereby determines said positions thereof.

17. A method of making a switch construction as set forth in claim 16 and including the steps of forming said terminal block to be cup-shaped so as to have a closed end means and an open end means, and forming said closed end means to have a cavity thereon that defines said spaced apart stop means.

18. A method of making a switch construction as set forth in claim 17 and including the step of forming said switch arm to have an outer end provided with a projection thereon that extends into said cavity for respectively engaging against said spaced apart stop means.

19. A method of making a switch construction as set forth in claim 18 and including the steps of forming said switch arm to have a longitudinal axis, and forming said switch arm to carry said magnet in an offset relation to said longitudinal axis thereof.

20. A method of making a switch construction as set forth in claim 19 and including the steps of forming said switch arm to have a tubular section disposed substantially transverse to said longitudinal axis thereof, and press-fitting said magnet into said tubular section.

* * * * *